US007108646B1

(12) United States Patent
Quick

(10) Patent No.: US 7,108,646 B1
(45) Date of Patent: Sep. 19, 2006

(54) INFANT ROLL CUSHION AND METHOD

(76) Inventor: Catherine G. Quick, 140 Crabapple La., Asheville, NC (US) 28804

( * ) Notice: Subject to any disclaimer, the term of this patent is extended or adjusted under 35 U.S.C. 154(b) by 0 days.

(21) Appl. No.: 10/701,999

(22) Filed: Nov. 4, 2003

Related U.S. Application Data

(60) Provisional application No. 60/426,020, filed on Nov. 12, 2002.

(51) Int. Cl.
*A63B 71/00* (2006.01)

(52) U.S. Cl. ..... 482/148; 482/907; 482/132; 482/62

(58) Field of Classification Search ..... 482/148, 482/140, 907, 91, 23, 62, 132; D21/665
See application file for complete search history.

(56) References Cited

U.S. PATENT DOCUMENTS

| | | | | | |
|---|---|---|---|---|---|
| 3,378,860 | A | * | 4/1968 | Frazier | 5/491 |
| 3,532,356 | A | * | 10/1970 | Lillibridge | 280/87.051 |
| 3,970,325 | A | * | 7/1976 | Wirsig | 280/87.041 |
| 3,992,023 | A | * | 11/1976 | Moorer | 280/87.021 |
| 4,060,100 | A | * | 11/1977 | Miller et al. | 138/89 |
| 4,441,221 | A | * | 4/1984 | Enste et al. | 5/657 |
| 4,569,532 | A | * | 2/1986 | Mirkarimi | 280/87.051 |
| 4,796,903 | A | * | 1/1989 | Proctor et al. | 280/87.051 |
| 4,862,535 | A | | 9/1989 | Roberts | |
| 5,261,134 | A | * | 11/1993 | Matthews | 5/655 |
| 5,272,780 | A | | 12/1993 | Clute | |
| 5,675,850 | A | * | 10/1997 | Schmitt | 5/630 |
| 5,675,853 | A | * | 10/1997 | Linge | 5/655 |
| 5,700,059 | A | | 12/1997 | Moscot | |
| 5,824,013 | A | * | 10/1998 | Allen | 606/240 |
| 5,857,232 | A | | 1/1999 | Mahdavi | |
| 5,857,237 | A | * | 1/1999 | Dranginis | 15/236.02 |
| 6,019,705 | A | * | 2/2000 | Thom et al. | 482/51 |
| 6,070,585 | A | | 6/2000 | Fery et al. | |
| D447,377 | S | * | 9/2001 | Valentini, Jr. | D6/613 |
| D471,752 | S | * | 3/2003 | Haboush | D6/613 |
| 6,536,057 | B1 | * | 3/2003 | Fennell et al. | 5/632 |
| 6,659,222 | B1 | * | 12/2003 | Allman | 181/282 |
| 6,694,550 | B1 | * | 2/2004 | Lee | 5/632 |
| 2003/0126684 | A1 | * | 7/2003 | Han | 5/630 |
| 2003/0135927 | A1 | * | 7/2003 | Hsia | 5/640 |

OTHER PUBLICATIONS

Abilitations Integrations Sensory Solution Spring 2005 Catalog, wwwIintegrationscatalog.com.*

William Sears, M.D. & Martha Sears, R.N., The Baby Book—Everything You need to Know About Your Baby—From Birth to Age Two, 1993, p. 449, First Edition.

* cited by examiner

*Primary Examiner*—Lori Amerson
(74) *Attorney, Agent, or Firm*—Carter, Schnedler, & Monteith

(57) ABSTRACT

An infant exercise cushion including a substantially rigid core element preferably in the form of a hollow pipe. A soft resilient material surrounds a substantial portion of the core element. The soft resilient material forms a curved outer surface for the cushion so that the cushion may be rolled on the floor when there is interface between the infant and the cushion.

1 Claim, 2 Drawing Sheets

INFANT ROLL CUSHION AND METHOD

RELATION TO PRIOR APPLICATION

This is a U.S. non-provisional application relating to and claiming the benefit of U.S. Provisional Application Ser. No. 60/426,020 filed Nov. 12, 2002.

BACKGROUND OF THE INVENTION

This invention relates to cushions for use by infants and more particularly relates to cushions for use by infants to increase upper body strength.

In 1992 the American Academy of Pediatrics implemented a nationwide campaign titled "Back to Sleep." The Back to Sleep campaign was designed to decrease the occurrences of sudden-infant death syndrome due to infants sleeping in the prone position and to encourage parents to place infants on their backs for sleeping. The Back to Sleep campaign has successfully led to a 40% reduction in sudden-infant-death syndrome. However, one negative factor of infants sleeping on their backs has been the delayed development of their upper body gross motor skills, specifically crawling.

Cylindrical and wedge-shaped cushions have heretofore been utilized as props for infant floor play. U.S. Pat. No. 5,675,853 issued to Linge shows a cushion for supporting an infant which enables the development of muscular strength and motor coordination. The Linge cushion is in the shape of a solid rectangle with a hollowed-out portion to receive the baby's torso. The Linge cushion also includes storage compartments for storing toys, diapers, and other baby related materials. U.S. Pat. No. 6,070,585 issued to Fery shows a spherical device used to support a baby to alleviate abdominal pain.

SUMMARY OF THE INVENTION

In accordance with one form of this invention, there is provided an infant exercise cushion, including a substantially rigid core element. A soft resilient material surrounds a substantial portion of said core element. The soft resilient material forms a curved outer surface for the cushion so that the cushion may be rolled on the floor when there is interaction between the infant and the cushion.

In accordance with another form of this invention, there is provided a device for enabling an infant to exercise his upper torso, including an elongated cushion. The cushion is in the shape of a cylinder. The cushion is made, at least in part, of a soft resilient material. The cushion includes first and second ends and a hollow cavity extending from the first end to the second end so that certain infant related items may be readily placed in the hollow cavity.

In accordance with another form of this invention, there is provided a method for exercising the upper torso of an infant utilizing a cushion, including a substantially rigid core element and a soft resilient material surrounding a substantial portion of the core element. The soft resilient material forms a curved outer surface for the cushion. The method includes the steps of: placing the cushion on a substantially flat surface; placing the front mid-section of the infant on the curved outer surface of the cushion; permitting the infant's hands to contact the flat surface; permitting the infant to roll the cushion, thereby exercising his upper torso.

In accordance with another form of this invention, there is provided a method for exercising the upper torso of an infant utilizing an elongated cushion which is in the shape of a cylinder. The cushion is made, at least in part, of a soft resilient material. The cushion includes first and second ends and a hollow cavity extending from the first end to the second end so that certain infant related items may be readily placed in the hollow cavity. The method includes the steps of: placing the cushion on a substantially flat surface; placing the front mid-section of the infant on the curved outer surface of the cushion; permitting the infant's hands to contact the flat surface; permitting the infant to roll the cushion, thereby exercising his upper torso.

BRIEF DESCRIPTION OF THE DRAWINGS

The subject matter which is regarded as the invention is set forth in the appended claims. The invention, however, can be better understood taken in conjunction with the accompanying drawings in which:

DESCRIPTION OF THE PREFERRED EMBODIMENT

The infant roll cushion of the present invention is designed to promote the development of infant upper body strength while providing incentive for the infant to explore the environment from a different perspective. In addition, the infant roll cushion enables the storage therein of infant related materials such as mats, toys, diapers and other items.

Figure 1:
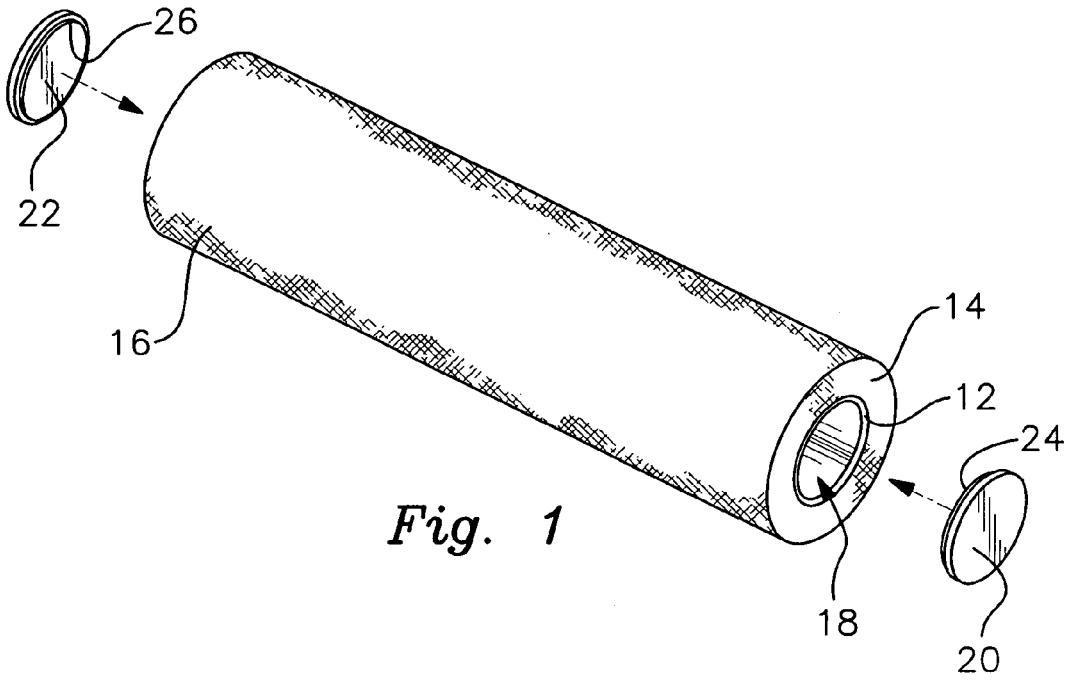
FIG. 1 is a perspective view of the infant roll cushion showing one embodiment of the subject invention.
Figure 2:
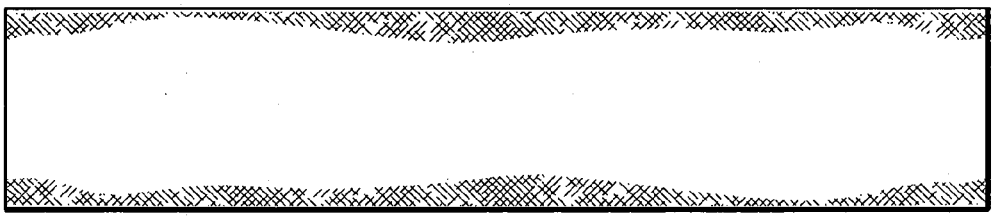
FIG. 2 is a side elevation view of the embodiment of FIG. 1.
Figure 3:
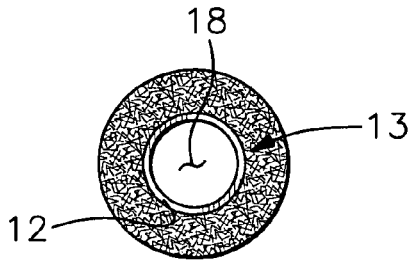
FIG. 3 is a sectional view of the embodiment of FIG. 1.

Referring now to FIGS. 1 through 3, there is provided a cylindrically shaped infant roll cushion 10 including a substantially rigid core element which may be hollow plastic pipe core 12 which is received inside of hollow cavity 13 of cushion 10 and runs along the longitudinal axis of the cushion. Pipe 12 is preferably made of PVC. A thick soft resilient material such as foam rubber 14 substantially covers pipe 12 so that cushion 10 has a curved outer surface. Fabric 16 covers the foam rubber 14. The hollow plastic pipe 12 performs a dual function. The pipe gives rigidity and strength for the cylindrical cushion and also provides for a hollowed-out region 18 so that one can store useful materials such as a mat, diapers, toys and the like which can also be utilized by the infant.

As shown in FIG. 1, preferably end caps 20 and 22 are provided to cover the first and second end openings 23 and 25 in the hollow pipe 12 so that items that are placed within space 18 will remain in that space during use. The end caps may include annular lips 24 and 26 which engage the inside annular surface of pipe 12 in a substantially interference fit. Alternatively the lips 24 and 26 may be threaded and the portion of the inside surface of the pipe near its ends may be corresponding threaded.

Preferably the cushion 10 is approximately 24 inches in length and approximately 8 inches in diameter. Also preferably the cushion is cylindrical in shape. In addition is preferred that the hollow plastic pipe 12 be approximately 4 inches in diameter. Also it is preferred that the resilient material 14 be foam rubber and be approximately 2 inches in thickness. The foam should completely cover the hollow plastic pipe so the rigid pipe will not tend to come in contact with the infant. If a floor mat is to be stored inside of the hollow space 18, it may be color coordinated with or substantially the same as the color of the fabric cover 16 which covers foam rubber 14.

Figure 4:
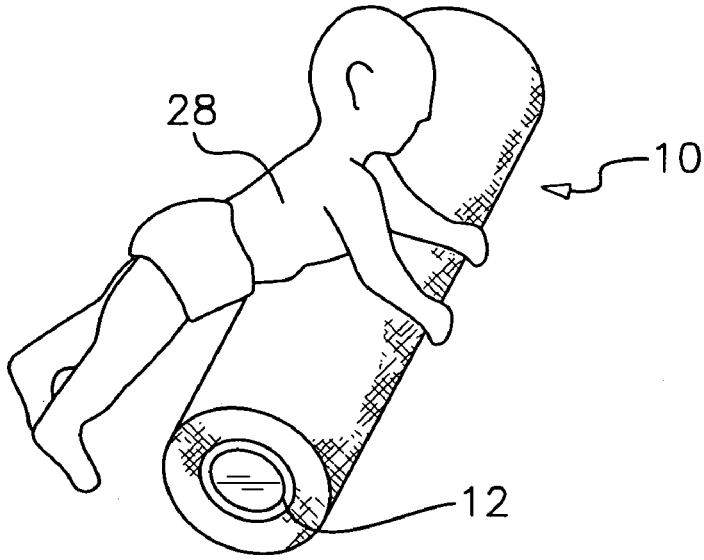
FIG. 4 is a perspective view of the embodiment of FIG. 1 showing use of the cushion by an infant.

FIG. 4 illustrates infant 28 utilizing his own ability to push himself in a back and forth motion utilizing his own foot and arm power and thereby exercising his upper torso.

Figure 5:
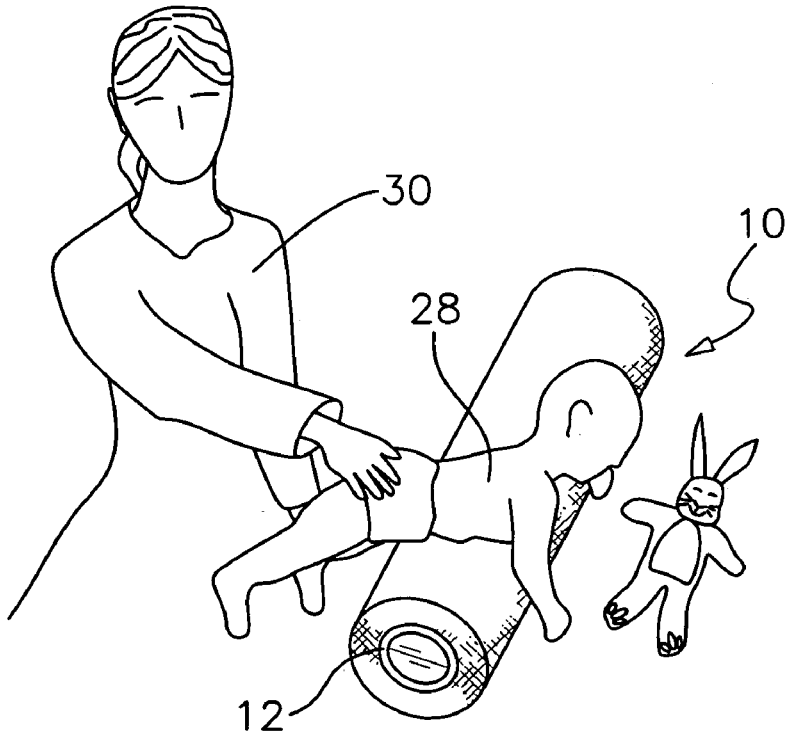
FIG. 5 is a perspective view of the embodiment of FIG. 1 showing an adult assisting an infant in the use of the cushion.

FIG. 5 illustrates an adult 30 stimulating the infant's physical awareness by holding the infant's legs in a secure manner. The infant's upper body is draped over the cushion 10. The physical and consequentially the visual stimulation of this exercise will provide the means necessary to promote the development of the infant's upper torso.

Infant roll cushion 10, which is described above, may be used as follows: Cushion 10 is placed on a substantially flat surface. The front mid-section of the infant is placed on the curved outer surface of the cushion. The adult 30 permits the hands of infant 28 to contact the flat surface. The adult 30 then permits the infant to roll the cushion using his arms and thereby exercising his upper torso.

Thus there is provided an infant roll cushion which not only promotes the development of upper body strength while providing incentive to explore one's environment from a different perspective, it also includes a convenient storage container for infant related items such as floor mats, toys and the like.

From the foregoing description of the preferred embodiment of the invention, it will be apparent that many modifications may be made therein. It will be understood that this embodiment of the invention is an exemplification of the invention only and that the invention is not limited thereto.

The invention claimed is:

1. A method for exercising the upper torso of an infant utilizing a cushion which includes a supportive core element, a soft resilient material surrounding a substantial portion of said core element, said soft resilient material forming a curved outer surface for the cushion comprising the steps of:

placing the cushion on a substantially flat surface in direct contact with the flat surface, placing the front mid-section of the infant on said curved outer surface of said cushion, permitting the infant's hands to contact the flat surface, and permitting the infant to roll the cushion thereby exercising his upper torso.

* * * * *